US005404732A

United States Patent [19]

Kim

[11] Patent Number: 5,404,732

[45] Date of Patent: Apr. 11, 1995

[54] AUTOMATIC WASHING MACHINE USING OZONE

[75] Inventor: Ji-Sung Kim, Anyang, Rep. of Korea

[73] Assignee: Samsung Electronics Co., Ltd., Suwon, Rep. of Korea

[21] Appl. No.: 136,701

[22] Filed: Oct. 15, 1993

[30] Foreign Application Priority Data

Oct. 16, 1992 [KR] Rep. of Korea ..... 92-19984

[51] Int. Cl.[6] ..... D06F 17/12

[52] U.S. Cl. ..... 68/13 R; 68/183; 261/122.1; 261/DIG. 42; 422/186.12; 422/186.14

[58] Field of Search ..... 68/13 R, 183; 261/122.1, DIG. 42; 422/305, 186.07, 186.08, 186.11, 186.12, 186.14

[56] References Cited

U.S. PATENT DOCUMENTS

| | | | |
|---|---|---|---|
| 3,065,620 | 11/1962 | Houser | 68/13 R |
| 3,090,745 | 5/1963 | Berghaus | 422/186.14 X |
| 3,130,570 | 4/1964 | Rentzepis | 68/13 R |
| 3,194,628 | 7/1965 | Cannon | 68/13 R X |
| 5,097,556 | 3/1992 | Engel et al. | 68/13 R X |
| 5,241,720 | 9/1993 | Engel et al. | 68/13 R X |
| 5,253,380 | 10/1993 | Lim et al. | 68/183 X |

FOREIGN PATENT DOCUMENTS 63-8797 2/1988 Japan .

*Primary Examiner*—Philip R. Coe

*Attorney, Agent, or Firm*—Burns, Doane, Swecker & Mathis

[57] ABSTRACT

An automatic clothes washing machine includes an outer housing, a tub mounted in the housing, and a perforated basket mounted in the tub. An ozone generator generates ozone which is conducted to water in the tub for sterilizing, bleaching and deodorizing clothes being washed. The ozone is conducted through a double-wall pipe to a perforated ozone distributor disposed between the tub and basket. The ozone generator comprises a flexible tube which is intermittently compressed by an electromagnetically controlled actuator for directing air toward an ozone-producing electrode.

17 Claims, 4 Drawing Sheets

AUTOMATIC WASHING MACHINE USING OZONE

BACKGROUND OF THE INVENTION

1. Field of the Invention

The present invention relates in general to an automatic washing machine, and more particularly to an automatic washing machine for sterilizing, bleaching and deodorizing laundry articles.

2. Description of the Prior Art

There has been proposed an automatic washing machine using a bleaching agent for bleaching laundry articles such as disclosed in Japanese Patent Publication Laid-Open Publication No. 63-8797. Referring to FIG. 1 showing the washing machine disclosed in the above Japanese patent, the washing machine comprises a main body supporter 102 arranged on the upper section of a washer main body 100. A suspension rod 104 is suspended from the supporter 102 by a slider 103 and provided at its lower end with a buffer tube 105. This buffer tube 105 includes a vibroisolating spring (not shown) such that it elastically suspends a tub 107 between a tub supporter 106 and the main body supporters 102. The washing machine further comprises a base plate 108 which is fixed to a bottom of the tub 107 and supports a clutch case 109. This clutch case 109 in turn engages at its upper section with the bottom of the tub 107 in such a manner that a watertight engagement of this clutch case 109 with the tub 107 is achieved. A drive motor 110 is mounted on the lower surface of the base plate 108 and includes a drive pulley 112 which is connected to a driven pulley 114 of a clutch shaft of the clutch case 109 by an endless belt 113 such that the rotational force of the drive motor 110 is transmitted to a clutch device of the clutch case 109 and in turn to a pulsator 118 rotatably connected to an output shaft of the clutch device at the bottom of a perforated washing and dehydrating basket 120.

The basket 120, used curtertly for washing and dehydrating the laundry articles, is provided at its circular upper end with a balance ring 122 changed with a detergent. The washing machine also comprises an upper panel which is integrally formed with a control panel 124 including a control switch and etc.. The upper panel t26 has an opening, through which the laundry articles to be washed and dried is thrown into the washing and drying basket 120 and which is covered with an openable lid 128.

In operation of the above washing machine, washing and rinsing of the laundry articles is followed by addition of a bleaching agent consisting of NaC10 and etc. into the tub 107 filled with washing water, so that the washed and rinsed laundry articles are bleached.

However, the above washing machine has a problem that the laundry articles treated by the bleaching agent should be sufficiently repeatedly rinsed to effect dechlorination, otherwise they are damaged by the bleaching agent and apt to be undesirably decolored.

SUMMARY OF THE INVENTION

It is, therefore, art object of the present invention to provide a fully automatic washing machine in which the aforementioned problems can be overcome and which uses ozone instead of a bleaching agent for bleaching of the laundry articles as well as for sterilization and deodorization of them.

It is another object of the present invention to provide a fully automatic washing machine in which ozone generated by an ozone generating device of a simple construction is supplied to an ozone dispersion member through a double wall pipe to prevent leakage of ozone to the outside and to achieve a desired safety against environmental contamination caused by the ozone.

To accomplish the above objects, a fully automatic washing machine in accordance with an embodiment of the present invention comprises a main body, a tub, a perforated washing and drying rotatable basket placed in the tub, and a pulsator placed on a bottom of the basket in order to form a water current in accordance with normal and reversed rotation of a drive motor, further comprising: an ozone generating device mounted on the main body for generation of ozone to be supplied to washing water in the tub; a connection member mounted on a lower section of the tub; a connection double pipe extending from the ozone generating means to the connection member; a perforated ozone dispersing member mounted on a lower surface of the tub for dispersing the ozone to the washing water in the tub, the ozone dispersing device being connected to the connection member by a connection tube in order to be supplied with the ozone generated by the ozone generating means through the connection pipe, the connection member and the connection tube in order.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
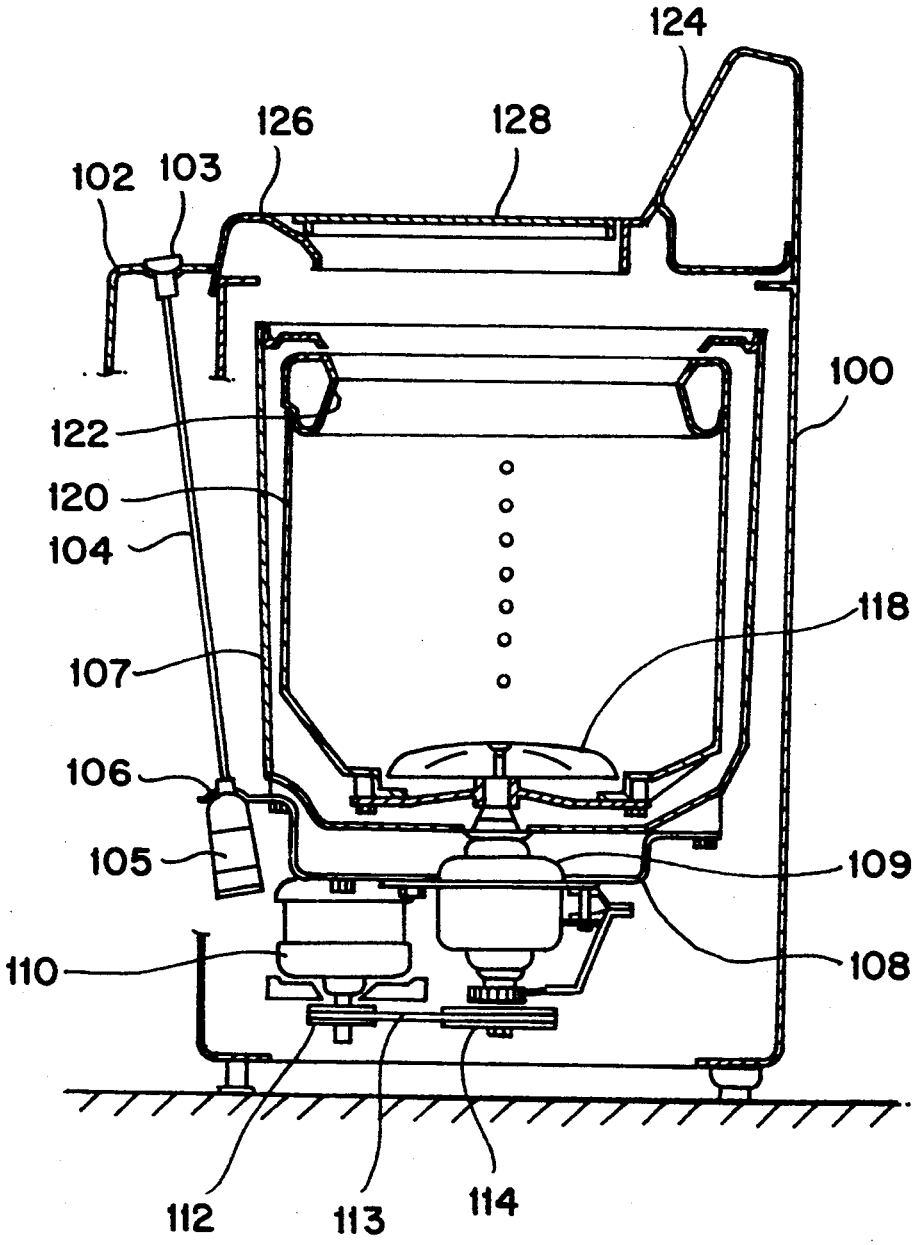
FIG. 1 PRIOR ART
FIG. 1 is a cross sectional view of an automatic washing machine using a bleaching agent for bleaching the laundry articles in accordance with the prior art.
Figure 2:
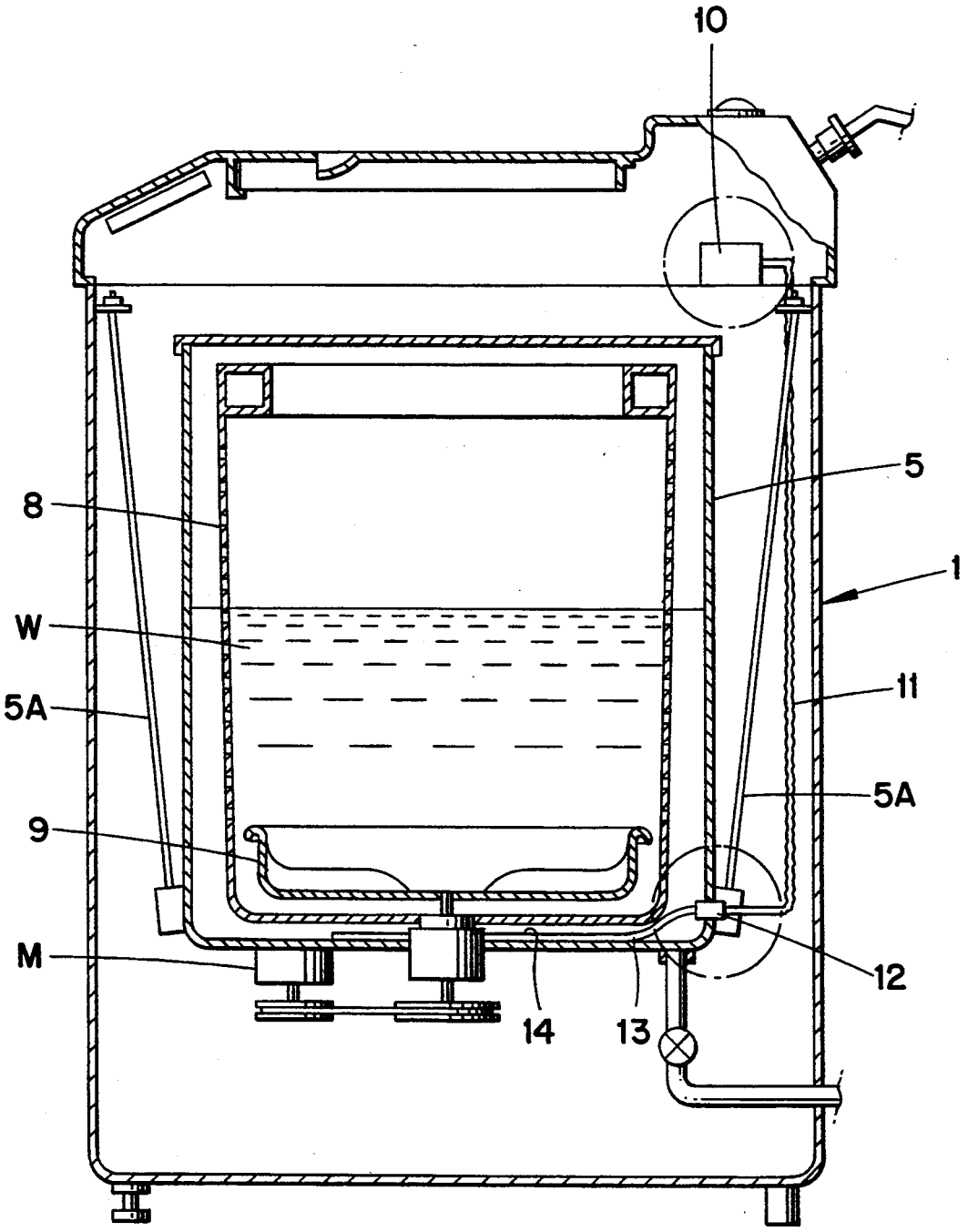
FIG. 2 is a cross sectional view of an automatic washing machine using ozone for bleaching the laundry articles in accordance with a preferred embodiment of the present invention.

With reference to FIG. 2, there is shown in a cross sectional view an automatic washing machine using ozone for bleaching the laundry articles in accordance with a preferred embodiment of the present invention. The washing machine comprises a main body 1 including a perforated washing and drying basket 8, which basket 8 is mounted on a clutch case such that it is rotated in a tub 5. The tub 5 is mounted to the main body by an arrangement of suspension rods 5A similar to that disclosed in connection with FIG. 1. The tub 5 and basket 8 define a clothes container assembly. A pulsator or agitator 9 is connected to an output shaft of a clutch device of a clutch case on the bottom of tile washing and drying basket 8 and rotated in both direction in accordance with normal and reversed rotation of a drive motor M mounted on the bottom surface of the tub 5, thus to form a violent water current and to wash the laundry articles in the washing and drying basket 8.

The washing machine further includes an ozone generating device 10 which is provided in the upper section of the main body 1 and generates ozone which is supplied to the inside of the tub 5 during washing of the laundry articles. A connection pipe 11 for introduction of the ozone generated by the device 10 into the tub 5 has one end connected to the ozone generating device 10 and the other end to a connection member 12 mounted on the lower section of the tub 5. The washing machine also comprises an ozone dispersion member 14 which is mounted on an inner surface of the bottom of tub 5 and disperses the ozone into the washing water W in the tub 5. This ozone dispersion member 14 is provided with a connection tube 13, extending between the member 14 and the connection member 12, thus to be supplied with the ozone generated by the ozone generating device 10 through the connection pipe 11, the connection member 12 and the connection tube 13 in order.

Figure 3:
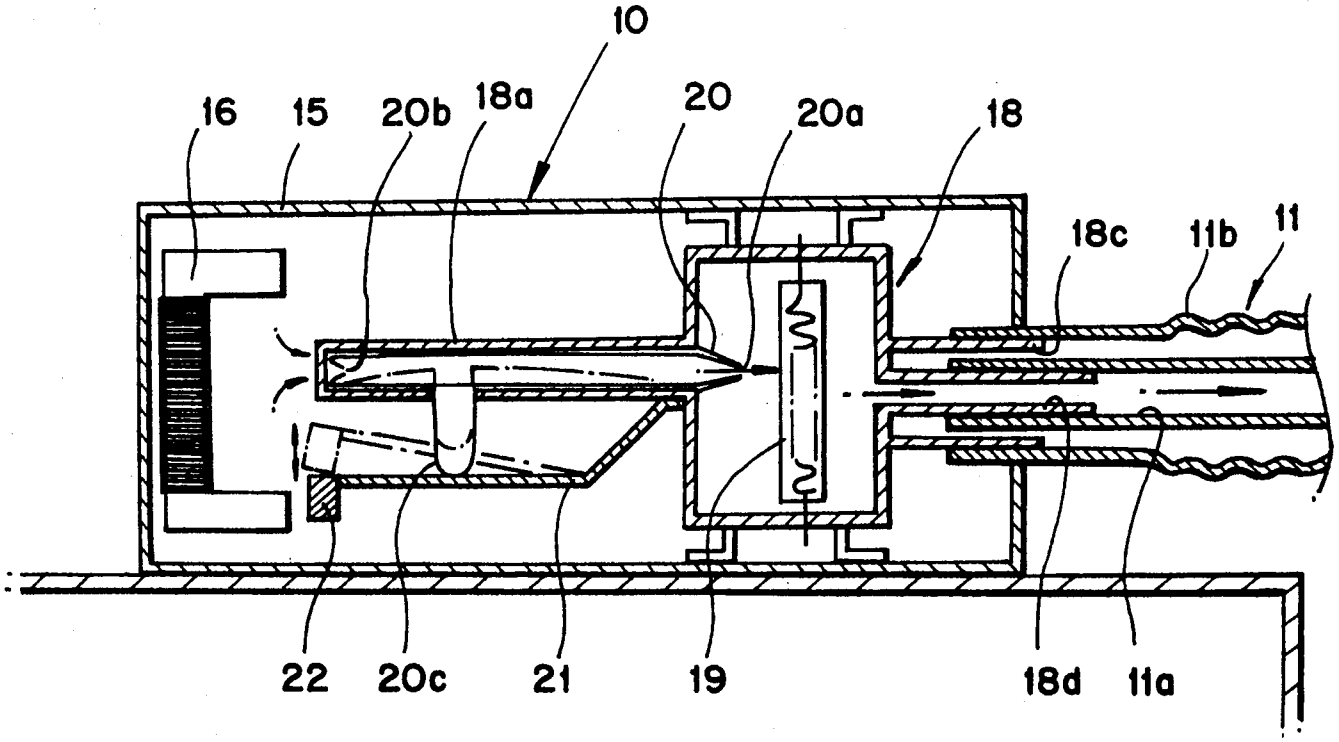
FIG. 3 is an enlarged sectional view of an ozone generating device of the washing machine of the present invention.

Turning to FIG. 3 showing the ozone generating device 10 of the washing machine of this invention in detail, this device 10 comprises a casing 15 which encases an electromagnet 16, generating magnetic force when it is applied with electric power at an end thereof, and an ozone generating part 18 placed at a side of the electromagnet 16.

The ozone generating part 18 includes art ozone generating electrode 19 which generates, when applied with the electric power, the ozone by discharging of air supplied thereto from an air outlet 20*a* of an air supply tube 20 described hereinbelow. This air supply tube 20 is inserted in a piping section 18*a* of the ozone generating part 18 and includes both the air outlet 20*a* and an air inlet 20*b* which are formed on both ends of the tube 20 for discharging and suction of the air. The tube 20 also includes a pressure projection 20*c* which is placed at a middle position between the outlet 20*a* and the inlet 20*b* such that it penetrates a side wall of the piping section 18*a* in order to contact with a vibration plate 21 at its distal end. This pressure projection 20*c* is advanced and retracted in accordance with vibration of the plate 21, thus to cause suction and discharge of the air through the air supply tube 20.

The vibration plate 21 is connected to the ozone generating part 18 under the piping section 18*a* of the part 18 in order to achieve a cantilever shape. This vibration plate 21 is provided at its distal end with a permanent magnet 22 which faces the electromagnet 16 in such a manner that they are spaced apart by a predetermined distance.

The ozone generating part 18 is connected at its output side to the end of the connection pipe 11

As shown in FIG. 3, the connection pipe 11 is a double pipe which is suitable for prevention of leakage of ozone and comprises an inner pipe 11*a* and an outer pipe 11*b* surrounding the inner pipe 11*a*. The outer pipe 11*b* of the connection pipe 11 preferably comprises a corrugated pipe such that it is movable and flexible and achieves easy connection to both the ozone generating part 18 and the connection member 12 of the tub 5.

When the electromagnet 16 is applied with the electric power, it generates magnetic force and this causes the permanent magnet 22 of the cantilever vibration plate 21 to be vibrated upwards and downwards. Due to such a vibration of the plate 21, the pressure projection 20*c* contacting the plate 21 moves upwards and downwards, to intermittently cause air to be discharged from the air outlet 20*a* as will be discussed. In order to achieve the aforementioned selective blocking operation, it is preferred to produce the tube 20 from a natural rubber or a silicon rubber. in addition, the tube 20 made of the natural rubber or of the silicon rubber facilitates air suction and air discharge, and prevents reversed flowing of the ozone.

Figure 4:
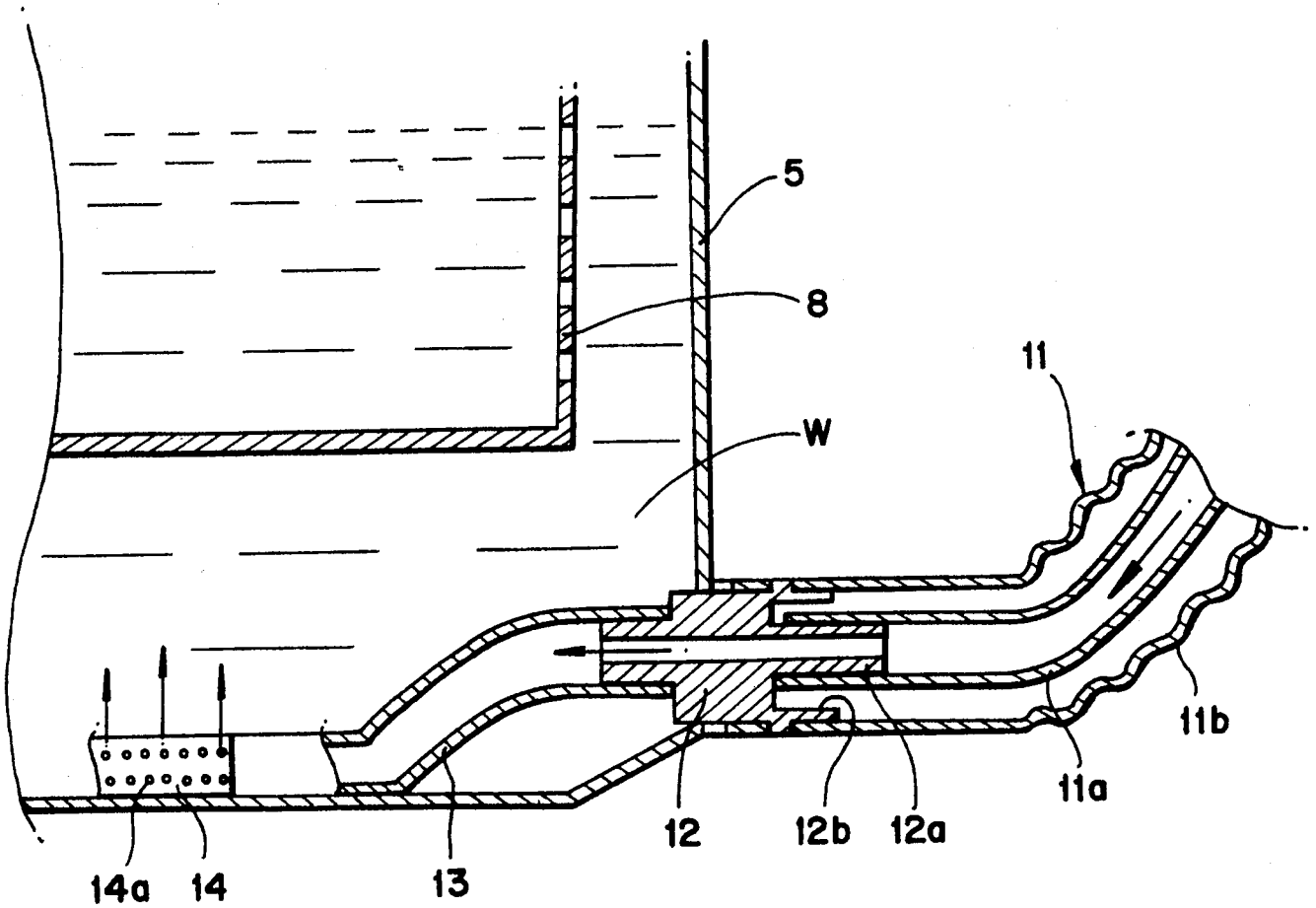
FIG. 4 is an enlarged sectional view showing connection of a connection member mounted on a lower section of a tub to a connection pipe, extending from the ozone generating device, and to a connection tube extending to an ozone dispersion member of the present invention.

Turning to FIG. 4, there is shown in a partially enlarged sectional view the connection of the connection member 12 mounted on the lower section of the tub 5 to both the connection pipe 11 extending from the ozone generating device 10 and to the connection tube 13 extending to the dispersion member 14. The inner pipe 11*a* of the connection pipe 11, of which an end is inserted on and connected to an inner pipe section 18*d* of the ozone generating device 10 as shown in FIG. 3, is inserted on and connected to an inner pipe section 12*a* of the connection member 12 at the other end thereof. In the same manner, the outer pipe 11*b* of the connection pipe 11, of which an end is inserted on and connected to an outer pipe section 18*c* of the ozone generating device 10, is inserted on and connected to an outer pipe section 12*b* of the connection member 12 at the other end thereof.

The ozone dispersion member 14, mounted on the inner surface of the bottom of tub 5, is connected to the connection member 12 by the connection tube 13 in order to be supplied with the ozone generated by the ozone generating device 10. This ozone dispersion member 14 is provided with a plurality of perforations 14*a*, through which the ozone supplied to the member 14 from the ozone generating device 10 through the connection pipe 11, the connection member 12 and the connection tube 13 is dispersed into the washing water W in the tub 5.

The operational effect of the above automatic washing machine will be described hereinafter.

When the laundry articles are thrown into the washing and drying basket 8 inside the tub 5 and a desired washing condition is selected using the control switch of the control panel, the washing ware r W is supplied to the inside of the tub 5 including the perforated washing and dehydrating basket 8 until the water surface reaches a predetermined level. Thereafter, the drive motor M starts to rotate in normal and reversed directions in order to rotate the pulsator 9 in both directions, thus to generate the water current and to wash the laundry articles in the basket 8 under the selected washing condition.

At this time, both the electromagnet 16 and the ozone generating electrode 19 of the ozone generating device 10 are applied with electric power, the electromagnet 16 generates magnetic force and causes the permanent magnet 22, mounted on the distal end of the cantilever vibration plate 21 and spaced apart from the electromagnet 16, to be vibrated upwards and downwards. Thus, the vibration plate 21 is repeatedly swung about its connection to the ozone generating part 18 and moves the pressure projection 20*c* upwards and downwards, thus to supply air to the ozone generating electrode 19.

That is, the upward and downward movement of the pressure projection 20*c* of the air supply tube 20 according to the vibration of the plate 21 makes the inside of the tube 20 be compressed and expanded. When the inside of the tube 20 is expanded by downward movement of the projection 20*c*, the air is introduced to the air inlet 20*b* of the tube 20. However, when the inside of the tube 20 is compressed by upward movement of the projection 20*c* tube flexes such that, the air inlet 20*b* closes, while the air outlet 20*a* opens. Hence, the air is continuously supplied to about the ozone generating electrode 19.

In addition, the air outlet 20*a* of the tube 20 close due to flexing of the tube during the air suction into the tube 20, thus to prevent reversed flowing of the ozone generated by the ozone generating part 18.

The air, supplied to the ozone generating electrode 19 in the ozone generating part 18, is discharged from the electrode 19 with a high voltage, thus to generate ozone ($O_3$). This ozone ($O_3$) is, thereafter, supplied to the ozone dispersion member 14 through the connection pipe 11, the connection member 12 and the connection tube 13, and dispersed to the washing water W in the tub 5 through the plurality of perforations 14*a* formed on the upper section of the member 14.

At this time, the connection pipe 11 is the double pipe comprising the inner pipe 11*a* and the corrugated outer pipe 11*b* as described above, so that it achieved a strong engagement with both the ozone generating device 10 and the connection member 12. Due to such a double construction of the connection pipe 11, ozone leakage to the outside is reliably prevented by the inner pipe 11*a* even when the outer pipe 11*b* is broken, thus to achieve the desired safety against the environmental contamination caused by the ozone.

As described above, a full automatic washing machine in accordance with the present invention continuously supplies ozone to the washing water in its tub in order to sterilize, bleach and deodorize laundry articles. The washing machine of this invention includes an ozone generating device which has both an air supply tube, inserted in a piping section of an ozone generating part of the device, and a pressure projection provided in the air supply tube in order to compress and expand the inside of the air supply tube in cooperation with a vibration plate. The ozone generating device is thus continuously supplied with air without an additional air supply pump, thereby having a simple construction and requiring small space for installation. A connection pipe, supplying the ozone of the ozone generating device to an ozone dispersion member prior to dispersion of the ozone to the washing water in the tub, is a double pipe comprising an inner pipe and a corrugated outer pipe, so that ozone leakage to the outside is reliably prevented even when the outer pipe is broken and a desired safety against the environmental contamination caused by the ozone is achieved. The corrugation of the outer pipe of the double connection pipe facilitates the pipe connection between this connection pipe and other elements and increases a resistance against outer shock.

Having described specific preferred embodiments of the invention with reference to the accompanying drawings, it is to be understood that the invention is not limited to those precise embodiments, and that various changes and modifications may be effected there in by one skilled in the art without departing from the scope or spirit of the invention as defined in the appended claims.

What is claimed is:

1. An automatic clothes washing machine comprising:

a main housing;

a clothes container assembly disposed in said main housing and including a motor-driven agitator;

an ozone generating for generating ozone;

an ozone distributor disposed in said clothes container assembly for distributing ozone into wash water in said clothes container assembly; and a conduit for conducting ozone from said ozone generating to said ozone distributor, said conduit including a connection pipe having a double wall structure comprised of inner and outer pipe sections, the inner pipe section conducting the ozone.

2. An automatic clothes washing machine according to claim 1, wherein said clothes container assembly comprises a tub and a perforated basket disposed in said tub, said ozone distributor disposed between said tub and said basket.

3. An automatic clothes washing machine according to claim 2, wherein said conduit means comprises a hollow connection member mounted on a wall of said tub, a connection pipe extending from said ozone generator to said connection member, and a connection tube extending from said connection member to said ozone distributor.

4. An automatic clothes washing machine according to claim 1, wherein said outer pipe section is corrugated.

5. An automatic clothes washing machine according to claim 1, wherein said ozone-generating means comprises an electrode for producing ozone from air supplied thereto, a flexible air supply tube having an inlet end and a discharge end directed toward said electrode, a movable member movable to a first position compressing said air supply tube in a manner discharging air through said discharge end, and to a second position for releasing the compression of said air supply tube to enable air to enter said air supply tube through said inlet end, and actuating means for intermittently moving said movable member between said first and second positions.

6. An automatic clothes washing machine according to claim 1, wherein said ozone distributor comprises a casing having a plurality of perforations formed in a wall thereof.

7. An automatic clothes washing machine according to claim 1, wherein said ozone distributor constitutes a gas distributor from which only gas is discharged.

8. An ozone generator comprising:

an electrode for producing ozone from air supplied thereto;

a flexible air supply tube having an inlet end and a discharge end directed toward said electrode;

a movable member movable to:

a first position compressing said air supply tube in a manner discharging air through said discharge end, and a second position for releasing the compression of said air supply tube to enable air to enter said air supply tube through said inlet end; and actuating means for intermittently moving said movable member between said first and second positions.

9. An ozone generator according to claim 8, wherein said actuating means comprises a first magnet mounted on said movable member for movement therewith, and a stationary second magnet disposed adjacent to said first magnet, one of said magnets comprising an electromagnet, and the other magnet comprising a permanent magnet, said magnets arranged to produce movement of said movable member between said first and second positions.

10. An ozone generator according to claim 9, wherein said first magnet constitutes said permanent magnet, and said second magnet constitutes said electromagnet.

11. An automatic clothes washing machine comprising:

a main housing;

a clothes container assembly disposed in said main housing and including a motor-driven agitator;

an ozone generator for generating ozone;

an ozone distributor disposed in said clothes container assembly for distributing ozone into wash water in said clothes container assembly; and conduit means for conducting ozone from said ozone generator to said ozone distributor;

said ozone generator comprising an electrode for producing ozone from air supplied thereto, a flexible air supply tube having an inlet end and a discharge end directed towards said electrode, a movable member movable to a first position compressing said air supply tube in a manner discharging air through said discharge end, and to a second position for releasing the compression of said air supply tube to enable air to enter said air supply tube through said inlet end, and actuating means for intermittently moving said movable member between said first and second positions.

12. An automatic clothes washing machine according to claim 11, herein said actuating means comprises a first magnet mounted on said movable member for movement therewith, and a stationary second magnet disposed adjacent to said first magnet, one of said magnets comprising an electromagnet, and the other magnet comprising a permanent magnet, said magnets arranged to produce movement of said movable member between said first and second positions.

13. An automatic clothes washing machine according to claim 12, wherein said first magnet constitutes said permanent magnet, and said second magnet constitutes said electromagnet.

14. An automatic clothes washing machine according to claim 12, wherein said air supply tube includes a projection extending from a side thereof intermediate said inlet and discharge ends, said projection bearing against said movable member.

15. An automatic clothes washing machine comprising:

a main housing;

a clothes container assembly disposed in said main housing and comprising a tub, a perforated basket disposed in said tub, and a motor-driven agitator disposed in said basket;

an ozone-generator for generating ozone;

an ozone distributor disposed in said clothes container assembly between said tub and said basket for distributing ozone into wash water in said clothes container assembly; and a conduit for conducting ozone from said ozone-generator to said ozone distributor.

16. An automatic clothes washing machine according to claim 15, wherein said ozone distributor comprises a casing having a plurality of perforations formed in a wall thereof.

17. An automatic clothes washing machine according to claim 15, wherein said ozone distributor constitutes a gas distributor from which only gas is discharged.

* * * * *